US005441199A

United States Patent [19]

Roberts et al.

[11] Patent Number: 5,441,199

[45] Date of Patent: Aug. 15, 1995

[54] SONICALLY WELDED HANDLE

[75] Inventors: John T. Roberts, Clover; Claude E. Monsees, Fort Mill, both of S.C.; Larry J. Mattson, Charlotte, N.C.

[73] Assignee: Roberts Systems, Inc., Charlotte, N.C.

[21] Appl. No.: 355,095

[22] Filed: Dec. 13, 1994

Related U.S. Application Data

[63] Continuation of Ser. No. 131,909, Oct. 5, 1993, abandoned.

[51] Int. Cl.[6] ..... B65D 25/32

[52] U.S. Cl. ..... 229/117.25; 220/773; 229/117.22; 493/88

[58] Field of Search ..... 229/117.25, 117.26, 229/117.22; 493/88; 16/110 R; 220/770, 773

[56] References Cited

U.S. PATENT DOCUMENTS

| | | | |
|---|---|---|---|
| 3,180,385 | 4/1965 | Kuroda | 220/760 |
| 3,638,822 | 2/1972 | McCoy . | |
| 3,927,812 | 12/1975 | Winters et al. . | |
| 4,399,926 | 8/1983 | Eidels-Dubovoy . | |
| 4,582,215 | 4/1986 | Barrash . | |
| 4,767,390 | 8/1988 | Herring . | |
| 4,775,093 | 10/1988 | Lin . | |
| 4,796,775 | 1/1989 | Dudzik . | |
| 4,816,014 | 3/1989 | Bratton et al. . | |
| 4,884,837 | 12/1989 | Nakazawa . | |
| 4,986,420 | 1/1991 | Gunn et al. | 229/117.25 |
| 5,058,748 | 10/1991 | Giblin et al. . | |
| 5,137,209 | 8/1992 | Roberts et al. . | |
| 5,209,394 | 5/1993 | Griffiths et al. . | |

FOREIGN PATENT DOCUMENTS

| | | | |
|---|---|---|---|
| 1164820 | 10/1958 | France | 493/88 |
| 2653748 | 5/1991 | France | 229/117.22 |

*Primary Examiner*—Stephen P. Garbe
*Attorney, Agent, or Firm*—Hardaway Law Firm

[57] ABSTRACT

A rotatable handle for a container is provided by sonic welding an inner disk to an outer strip of a handle, the disk permitting the rotation of the handle and providing a seal for the container openings through which the handle is connected.

11 Claims, 2 Drawing Sheets

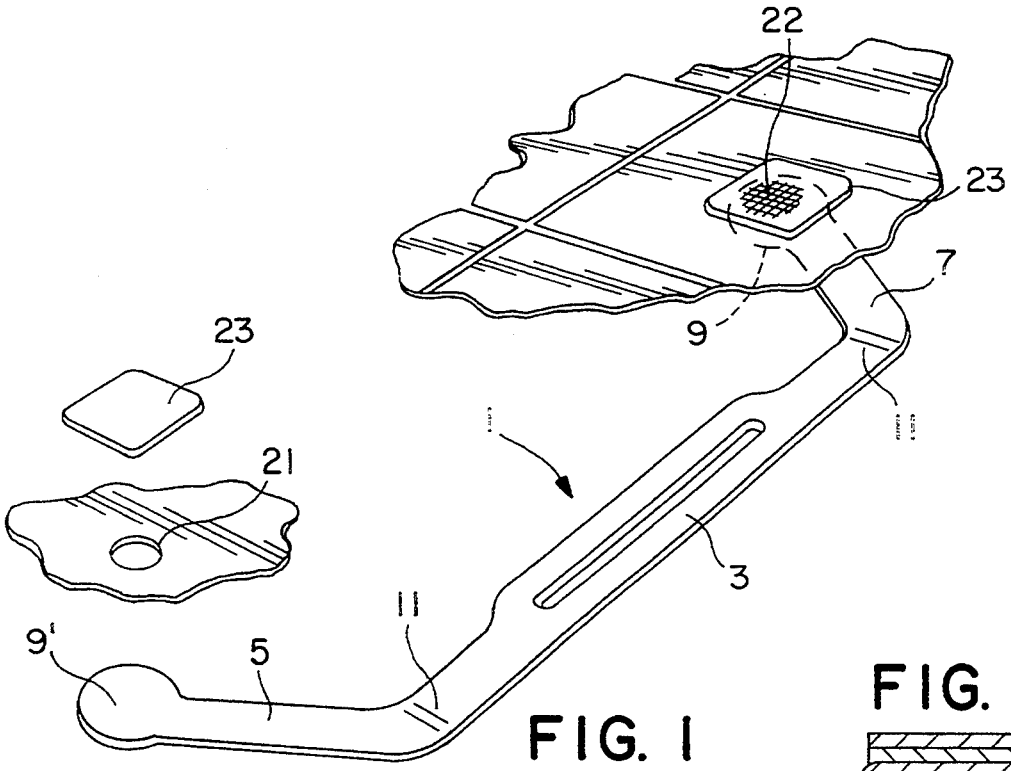
FIG. 1
FIG. 3
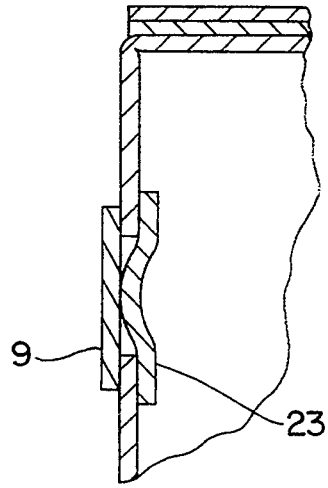
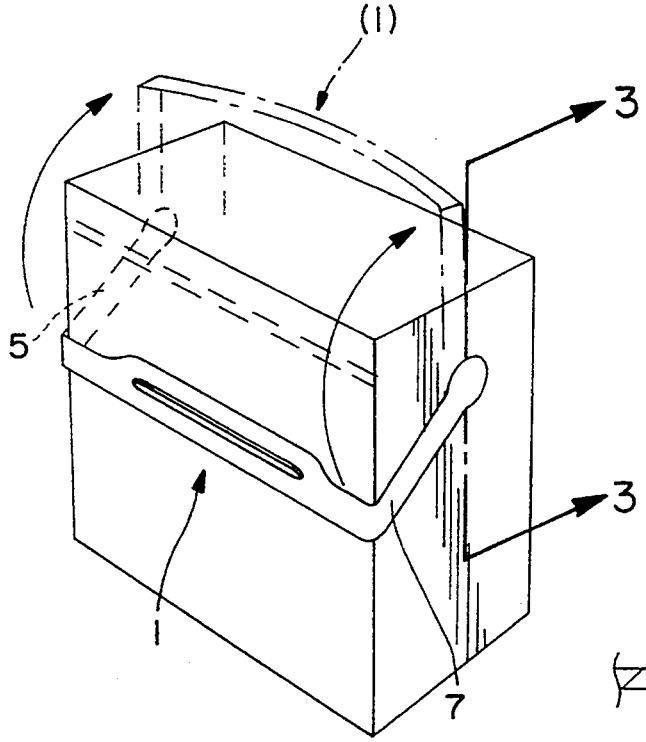
FIG. 2
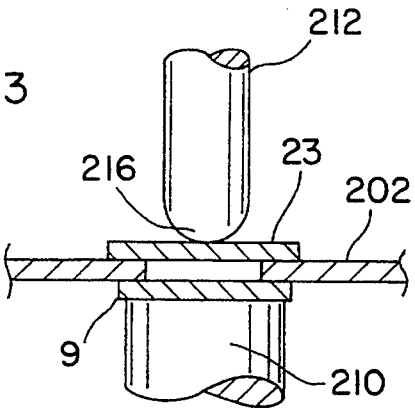
FIG. 4

SONICALLY WELDED HANDLE

This application is a file wrapper continuation, of application Ser. No. 08/131,909, filed Oct. 5, 1993, now abandoned.

BACKGROUND OF THE INVENTION

This invention is directed towards an improved handle and attachment means for use with paste board and cardboard containers which permit the movement of the handle in an arc about the container.

A variety of handles which can move relative to the container are known in the prior art. Representative handle types include U.S. Pat. No. 3,768,720 to Bundy which teaches a handle having terminal lugs which are used to secure a handle to a container. Bayonet handles, as referenced in U.S. Pat. Nos. 5,137,209 and 5,095,683 provide a handle in which barbed ends are inserted through carton apertures, the handles being retained by the barbed head which engages the aperture. While this arrangement permits rapid handle installation, the aperture/handle connection requires the use of an inner liner or a separate seal to avoid product loss or product contamination. Therefore, there is room for variation and improvement within the art.

SUMMARY OF THE INVENTION

It is thus an object of this invention to provide a rotatable handle and handle attachment method suitable for cartons.

It is a further object of this invention to provide a method of attaching a handle which enables the handle to be folded along with the carton blank.

It is a further and more particular object of this invention to provide an intermittent motion apparatus and process for installing a swing-type handle to a carton.

It is yet a further object of this invention to provide an attachment means and a handle which eliminates the need for carton liners.

It is a further object of this invention to provide a sonically welded handle which permits movement of the handle relative to the carton.

These as well as other objects of the invention are accomplished by a swing handle comprising a flexible strap having a first end, a second end, the first end and the second end further defining a respective engaging surface, the engaging surface positioned in proximity to a corresponding carton blank aperture; a first disk secured to a first engaging surface through a first carton blank aperture; a second disk secured to a second engaging surface through a second carton blank aperture, thereby securing each handle end through the corresponding aperture, the respective pair of handle engaging means permitting the handle to rotate about the carton and the attachment means sealing the aperture to prevent loss or contamination of the package contents.

BRIEF DESCRIPTION OF THE DRAWINGS

FIG. 1 of the drawings is a perspective view of an unfolded handle with the securing disk unattached.

FIG. 2 of the drawings is a perspective view of a preferred embodiment of the handle attached to an assembled carton with an engaging position of the handle shown in phantom.

FIG. 3 of the drawings is an exploded view along line 3—3 of FIG. 2 showing the relative position of the handle components to an assembled carton.

FIG. 4 of the drawings is a elevation in partial section of a handle and disk being installed onto a carton.

DETAILED DESCRIPTION

Figure 5:
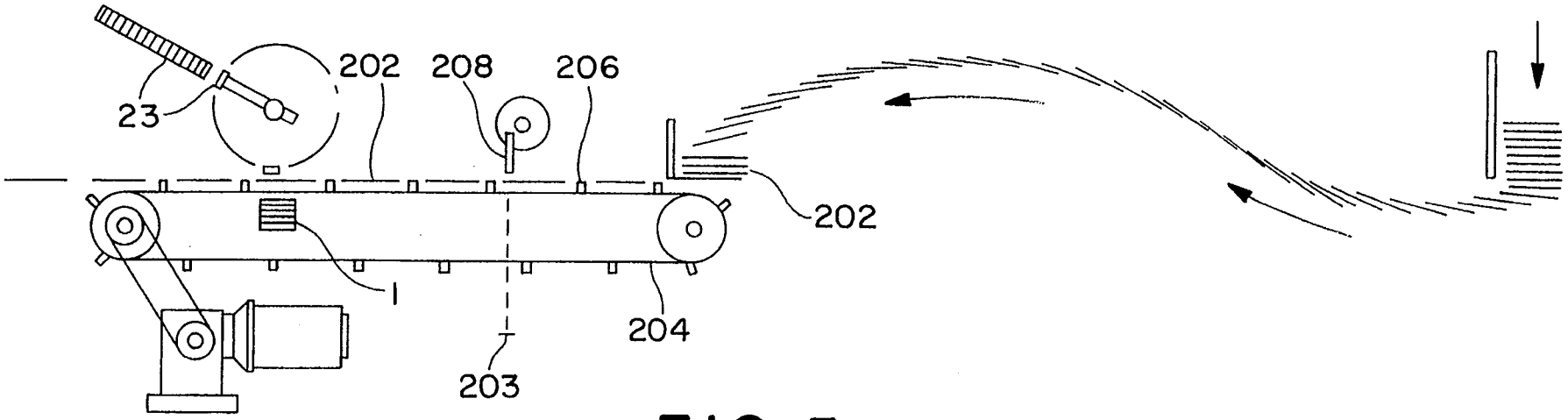
FIG. 5 of the drawings is a diagrammatic view of the process of installing handle on the carton.

In accordance with this invention it has been found that an improved container handle and attachment means can be provided which enable pivoting of the handle relative to the container. Further, the attachment means effectively seals the handle openings defined by the container, therefore eliminating the need for a separate container liner.

A preferred embodiment of the present invention is seen in reference to FIGS. 1 through 3 of the drawings. Handle assembly 1 is provided by a substantially thin and flat strap 3 having an angled first end 5 and an angled second end 7. A pair of circular tabs 9 and 9' are defined and associated with a terminus of handle ends 5 and 7.

A pair of score lines 11 are provided along each terminus of strap 3 in proximity to the respective angled ends 5 and 7. Score lines 11 permits relative movement between the handle ends and the strap. As best seen in FIGS. 2 and 3, circular tabs 9 and 9' are adjacent to apertures 21 which are provided along either side of an assembled carton as defined herein, aperture includes any sized or shaped container opening. Handle 1 is secured to the carton by the adhesion of a portion of each circular tab 9 and 9' to a disk 23. Disk 23 is positioned against the interior carton surface adjacent to aperture 21, aperture 21 providing communication between tab 9 and disk 23.

A preferred securing method of attaching the handle to the carton is through sonic welding of the disk to the end tab, the resulting weld being indicated by knurled pattern 22 as seen in FIG. 1. The weld provides a strong attachment means for securing handle 1 to the container. As seen in reference to FIG. 2, the handle attachment means permits handle 1 to rotate away from the illustrated first stored position to a second engaging position seen in phantom. An additional feature of the handle 1 is that aperture 21 is effectively sealed by the interaction of the disk/tab weld. Ideally, the physical dimensions of the weld are slightly less than the aperture in order to insure a tight and strong seal. However, circular and square welding patterns have both been found effective in maintaining product integrity.

Preferably, tabs 9 and 9' as well as the sealing disk 23 have a perimeter margin which overlaps the respective exterior and interior carton surrounding each aperture. The oversized structures facilitate the coordination in positioning the handle components relative to apertures within carton blank stock. In addition, the overlap, in combination with the tight sonic weld, seals the carton contents from leakage or outside contamination while still permitting rotation. As a result, separate carton liners are avoided which saves on material costs as well as reducing the amount of post-consumer waste.

Handle 1, including disk 23, is preferably constructed from a resilient plastic such as high density polyethylene. High density polyethylene is recyclable, amenable to sonic welding, scoring, and permits component parts to be supplied in a preferred cartridge configuration which facilitates high speed installation of a handle. Since sonic welding does not introduce any adhesives, the handle assembly is more readily recyclable and avoids problems of misdirected adhesive during the installation process. Polyethylene also permits a rigid disk to be provided which helps seal the carton opening and resists deforming which could impair the effectiveness of the seal.

However, the present handle and tabs can also be secured by the use of well known adhesives, heat sealing, or mechanical connections such as rivets. Such alternative securing means will maintain the rotation and aperture sealing feature of the handle.

As seen in reference to FIGS. 2, the length of strap 3 conforms to the width of the assembled carton face exterior. The length of each handle end 5 and 7 is of sufficient length and angle such that the respective tabs are in proximity to the exterior aperture surface associated with each side of the carton. The carton apertures are positioned along the carton side so as to permit clearance of the engaging strap over the carton top.

While the preferred embodiment illustrates circular tabs, there are numerous other configurations and shapes which can be utilized. For instance, a series of tabs can be located along each handle end to accommodate varying placed apertures encountered with the associated carton stock. In addition, alternative sets of score lines can be provided on the strap portion of the handle to permit smaller cartons to be engaged by a single sized handle.

With precise installation and spotting techniques, the unmodified strap-like ends can directly be engaged through the aperture so long as the width of the handle end is greater than the dimension of the aperture. The aperture itself need not be circular as any appropriate sized opening will suffice.

A preferred method of installation of the handle takes advantage of the fact that the handle components can be supplied and dispensed from a cartridge form, as best described in U.S. Pat. No. 4,946,536 and 4,832,537 are incorporated herein by reference. Cartridge dispensing facilities spacial and temporal coordination with associated carton blanks and attachment steps as described below.

In a preferred method of installation, a stacked supply of carton blanks 202 are retained within a magazine, each carton blank having preformed perforations. The carton blanks are singulated and fed with the interior surface up to an associated belt conveyor 204 having lugs 206 for carrying the carton blanks. Belt 204 is driven by intermittent means such as a CAMCO geneva drive mechanism. A pair of reciprocating dies 208 are used to disengage perforations 203 from blanks 202. Following advancement of at least one carton blank width, the carton blank and conveying means are stopped while the handle and the disk are applied and secured.

As best seen in reference to FIG. 4, a single handle 1 is dispensed below conveyor 204 and spotted so the handle 1 is adjacent to the exterior surface of the carton blank stock. Upon receiving handle 1, guide plate 210 directs the handle tabs against the exterior carton blank surface, the tabs then being firmly pressed against the exterior aperture opening by the guide plate. In coordination with the handle dispensing and placement, a disk cartridge dispenser positions a disk adjacent to each inner aperture opening.

As seen in FIG. 4, when tabs 7 and 9 are in proximity to the exterior aperture surface, corresponding disks 23 are positioned on the opposite side of the aperture. Each disk is thereafter attached through the aperture to the corresponding portion of the handle tab by sonically welding the overlapping portions through the common aperture overlap. The welding steps are accomplished by an ultrasonic welders 212 having a horn tip 216 which engages the respective disk opposite the corresponding aperture. Point pressure is applied to the disk by the horn tip, the sonic welder operating at a frequency of around 30,000 Hertz which has been found to seal the disk to the tab in approximately 0.25 seconds. However, a wide range of time, pressure and frequency combinations can be selected for particular applications. The horn tip can be of a circular, rectangular or any other configuration which will permit the sonic welding oscillation and pressure to be transmitted through the aperture.

To facilitate the welding process, handle guide means 210 also retain the tabs in a fixed, flush position against the aperture so that downward point pressure of the horn is conveyed to the tab. Following welding, the disk side of the weld forms a concave depression which extends through the aperture, bonding with the adjacent tab. However, the welding tip and point pressure could be supplied from the opposite direction with the welding depression then occurring on the handle tabs. Upon disengagement of the horn tip, the carton and attached handle are transported to an associated apparatus for folding and filling a carton.

The preferred embodiment of the rotating handle permits the handle to be folded passively as the carton blank is folded. As seen in FIG. 1, strap 3 corresponds to the length of the assembled front carton panel. The folding of the side panels, to which handle ends 5 and 7 are attached, permits handle 1 to bend along score lines 11. This arrangement automatically folds handle 1 in the desired position as the carton blank stock is assembled into a carton.

The present invention offers several advantages over current handles. Attachment means of the handle with the tab/disk connector effectively seals the apertures against product leakage and contamination. As a result, separate liners do not need to be installed. However, the instant invention is compatible with a liner, the inner liner simply being installed over the welded disks. Further, the welded disk/tab connection permits the handle to flip from a flush shipping profile into an upright carrying position, the weld permitting the tab/disk securing means to rotate about the aperture. In addition, no separate folding or insertion steps are required for installing the handle.

As numerous modifications of the preferred embodiment of the handle in the process described above are possible to one having ordinary skill in the art upon reading the description, the scope of the present invention is hereby set forth by the following appended claims.

That which is claimed:

1. A rotatable handle assembly attached to a container comprising:

a flexible strap having a first end and a second end, said first and said second end each defining a respective first engaging surface and a second engaging surface;

a first disk integrally secured to said first engaging surface in a manner allowing no relative movement between said first disk and said first engaging surface;

a second disk integrally secured to said second engaging surface in a manner allowing no relative movement between said second disk and said second engaging surface;

wherein, said first engaging surface is integrally secured to said first disk through a first opening in a container and said second engaging surface is integrally secured to said second disk through a second opening in a container, thereby providing a rotatable handle.

2. The handle according to claim 1 wherein said first disk and said second disk are secured to said scrap by a sonic weld.

3. The handle according to claim 1 wherein said first disk and said second disk are secured to said strap by heat sealing.

4. The handle according to claim 1 wherein said first disk and said second disk are secured to said strap by an adhesive.

5. A process of installing a leak resistant, rotatable handle to a container, said process comprising the steps of:

providing a carton blank having a first opening and a second opening for mounting a handle;

spotting a first handle end opposite said first opening along an exterior of said carton blank;

spotting a second handle end opposite said second opening along an exterior of said carton blank;

positioning a first disk upon an interior of said carton, said disk opposite said first opening;

positioning a second disk upon an interior surface of said carton, opposite said second opening;

attaching said first handle end to said first disk, a portion of said first handle end and said first disk in communication through said opening;

attaching said second handle end to said second disk, a portion of said second handle end and said second disk in communication through said second opening;

wherein said attachment of said handle to said disks permits said handle to rotate relative to said container, said first disk and said second disk maintaining a seal of said respective container openings when said handle is rotated.

6. A container having a rotatable handle, said container comprising:

a top;

a bottom;

a front;

a back;

a first side having an inner surface and an outer surface, said inner and outer surfaces in communication by a first aperture defined by said first side;

a second side having an inner surface and an outer surface, said inner surface and said outer surface in communication by a second aperture defined by said second side;

a handle, said handle further comprising a flexible strap having a first end, said first end further defining a first engaging surface opposite said first aperture on said outer surface;

a second end, said second end further defining a second engaging surface opposite said second aperture on said outer surface;

a first disk integrally secured through said first side aperture to said first engaging surface;

a second disk integrally secured through said second aperture to said second engaging surface;

wherein said handle rotates from a first stored position to a second carrying position.

7. The container of claim 6 wherein said first and said second sonically welded disks provide a seal for said container apertures.

8. The container of claim 6 wherein said flexible strap defines a first hinge adjacent said first engaging surface and a second hinge adjacent said second engaging surface.

9. A rotatable handle assembly attached to a container comprising:

a strap having a first end and a second end, said first and said second end each defining a respective first engaging surface and a second engaging surface;

a third engaging surface integrally secured to said first engaging surface, through a first opening in a container, in a manner allowing no relative movement between said third engaging surface and said first engaging surface; and a fourth engaging surface integrally secured to said second engaging surface, through a second opening in a container, in a manner allowing no relative movement between said fourth engaging surface and said second engaging surface.

10. The combination according to claim 9, wherein said third and fourth engaging surfaces are first and second disks, respectively.

11. The combination according to claim 9, wherein said strap is flexible.

* * * * *